US010544800B2

(12) United States Patent
Koga et al.

(10) Patent No.: US 10,544,800 B2
(45) Date of Patent: Jan. 28, 2020

(54) INLET GUIDE VANE AND CENTRIFUGAL COMPRESSOR

(71) Applicant: MITSUBISHI HEAVY INDUSTRIES THERMAL SYSTEMS, LTD., Tokyo (JP)

(72) Inventors: Jun Koga, Tokyo (JP); Yasushi Hasegawa, Tokyo (JP); Shintaro Omura, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 12 days.

(21) Appl. No.: 15/565,732

(22) PCT Filed: Oct. 21, 2015

(86) PCT No.: PCT/JP2015/079650
§ 371 (c)(1),
(2) Date: Oct. 11, 2017

(87) PCT Pub. No.: WO2016/166910
PCT Pub. Date: Oct. 20, 2016

(65) Prior Publication Data

US 2018/0080470 A1 Mar. 22, 2018

(30) Foreign Application Priority Data

Apr. 14, 2015 (JP) ..... 2015-082553

(51) Int. Cl.
*F04D 29/44* (2006.01)
*F04D 29/46* (2006.01)
(Continued)

(52) U.S. Cl.
CPC ..... *F04D 29/442* (2013.01); *F04D 29/462* (2013.01); *F04D 17/10* (2013.01); *F04D 29/284* (2013.01)

(58) Field of Classification Search
CPC ..... F04D 29/284; F04D 29/444; F04D 29/30; F04D 29/667; F04D 17/08; F04D 29/544
See application file for complete search history.

(56) References Cited

U.S. PATENT DOCUMENTS 4,743,161 A * 5/1988 Fisher ..... F04D 29/4213 415/116
5,947,680 A * 9/1999 Harada ..... F04D 27/0284 415/17

(Continued)

FOREIGN PATENT DOCUMENTS

JP 60-28300 U 2/1985
JP 11-22695 A 1/1999

(Continued)

OTHER PUBLICATIONS

Office Action dated Jan. 22, 2019 in corresponding Japanese Application No. 2015-082553 with an English Translation.

*Primary Examiner* — Long T Tran
(74) *Attorney, Agent, or Firm* — Birch, Stewart, Kolasch & Birch, LLP

(57) ABSTRACT

Provided are an inlet guide vane and a centrifugal compressor such that air can be caused to efficiently flow in with use of a simple shape. The inlet guide vane is disposed upstream of an impeller in a flow path of a centrifugal compressor. The inlet guide vane has: a plate-shaped plate section that is disposed in the flow path; and a rotation part that causes the plate section to rotate along an axis of rotation aligned with the radial direction of a rotary shaft of the centrifugal compressor. In a cross-section orthogonal to the axis of rotation of the rotation part, the plate section has, at the (Continued)

leading edge thereof on the upstream side of the flow path, a bent part that is tilted with respect to the other portions.

12 Claims, 10 Drawing Sheets

(51) Int. Cl.
*F04D 17/10* (2006.01)
*F04D 29/28* (2006.01)

(56) References Cited

U.S. PATENT DOCUMENTS 6,039,534 A * 3/2000 Stoner ..... F01D 17/162 415/150
6,039,634 A * 3/2000 Bach ..... B23Q 1/4857 451/49
6,276,896 B1 * 8/2001 Burge ..... F01D 5/048 415/115
2005/0002782 A1 * 1/2005 Nikpour ..... F04D 27/0246 415/208.1
2009/0035122 A1 * 2/2009 Yagi ..... F04D 29/284 415/1
2012/0102969 A1 * 5/2012 Wagner ..... F02C 6/08 60/785
2015/0192133 A1 * 7/2015 An ..... F02B 37/225 415/203
2015/0337863 A1 * 11/2015 Tomita ..... F04D 29/4213 415/58.4
2015/0354591 A1 * 12/2015 Ibaraki ..... F04D 27/0253 415/147
2016/0108920 A1 * 4/2016 Yamashita ..... F04D 17/10 415/204

FOREIGN PATENT DOCUMENTS

JP 2009-41431 A 1/1999
JP 2002-327700 A 11/2002
JP 2013-245575 A 12/2013

* cited by examiner

INLET GUIDE VANE AND CENTRIFUGAL COMPRESSOR

TECHNICAL FIELD

The present invention relates to an inlet guide vane which can adjust an opening degree and a centrifugal compressor having the same.

BACKGROUND ART

In turbo refrigerators, petrochemical plants, natural gas plants, or the like, a centrifugal compressor is used. In the centrifugal compressor, kinetic energy is applied to a fluid by a rotation of as impeller, and an increase in pressure is obtained by a centrifugal force by blowing the fluid to the outside in a radial direction. As the centrifugal compressor, there is a centrifugal compressor having an inlet guide vane which regulates air flowing into the upstream side of the impeller and adjusts the amount of the flowing-in air (refer to PTL 1). The inlet guide vane makes an angle with respect to the impeller, that is, an opening degree variable to change a resistance in a flow path, and thus, can adjust the amount of the flowing-in air.

CITATION LIST

Patent Literature

[PTL 1] Japanese Unexamined Patent Application Publication No. 2002-327700

SUMMARY OF INVENTION

Technical Problem

In order to achieve decrease turbulence generated in a flow of a fluid, in most cases, the inlet guide vane is formed in a blade shape. Since the inlet guide vane is formed in a blade shape, a lot of time and cost are taken for processing the inlet guide vane.

The present invention is to solve the above-described problem, and an object thereof to provide an inlet guide vane which can effectively perform inflow of air with a simple shape and a centrifugal compressor having the same.

Solution to Problem

In order to the above-described object, according to an aspect of the present invention, there is provided an inlet guide vane which is disposed on an upstream side of an impeller in a flow path of a centrifugal compressor, the vane including: a plate-shaped plate portion which is disposed in the flow path; and a rotation portion which rotates the plate portion with an axis in a radial direction of a rotary shaft of the centrifugal compressor as a rotation axis, in which the plate portion includes a bent portion inclined with respect to other portions at a leading edge on an upstream side of the flow path in a cross-section orthogonal to the rotation axis of the rotation portion.

In addition, preferably, a center line of the bent portion is a curved line in the cross-section orthogonal to the rotation axis of the rotation portion.

Moreover, preferably, a center line of the bent portion is a curved line in the cross-section orthogonal to the rotation axis of the rotation portion.

In addition, preferably, a boundary position between the bent portion and other portions with respect to the entire length L in a longitudinal direction of the plate portion in the cross-section orthogonal to the rotation axis of the rotation portion is constant.

Moreover, preferably, the bent portion is formed within a range from 0.1 L to 0.3 L on the leading edge side on the upstream side in the flow path with respect to the entire length L.

In addition, preferably, a distance between the rotation axis of the rotation portion in the cross-section orthogonal to the rotation axis of the rotation portion and the boundary position between the bent portion and the other portions is constant.

Moreover, preferably, the bent portion is formed within a range from 0.1 L to 0.3 L on the leading edge side on the upstream side in the flow path with respect to the entire length L in the longitudinal direction of the cross-section orthogonal to the rotation axis, at a position from 0.35 D to 0.7 D from the outer end portion in the radial direction with respect to a distance D of the outer end portion in the radial direction of the plate portion from the rotation axis.

In addition, preferably, the bent portion is formed within a range from 0.1 L to 0.3 L on the leading edge side on the upstream side in the flow path with respect to the entire length L is the longitudinal direction of the cross-section orthogonal to the rotation axis, at a position of 0.5 D with respect to the distance D of the outer end portion in the radial direction of the plate portion from the rotation axis.

In addition, preferably, the bent portion is inclined toward a side to be rotated at the time of being throttled.

Moreover, preferably, the bent portion is inclined toward a side to be rotated at the time of having an excessive opening degree.

In addition, preferably, in the bent portion, a slit is formed from a surface on which as angle between the surface and the other portions is larger than 180° toward a surface on which an angle between the surface and the other portions is less than 180°, and in the slit, an opening of a surface side on which an angle between the surface and the other portions is larger than 180° is formed on an upstream side in the flow direction of an opening of a surface on which an angle between the surface and the other portions is less than 180°.

In order to achieve the above-described object, according to another aspect of the present invention, there is provided a centrifugal compressor, including: the above-described inlet guide vane; and an impeller which is disposed on a downstream side of the inlet guide vane.

Advantageous Effects of Invention

According to the present invention, a shape obtained by processing a portion of a plate shape is provided, and thus, it is possible to simplify the shape, and it is possible to decrease loss generated at the time of a set usage.

DESCRIPTION OF EMBODIMENTS

Hereinafter, embodiments according to the present invention will be described in detail with reference to the drawings. In addition, the present invention is not limited by the embodiments. In addition, components described in the following embodiments include components which can be replaced by a person skilled in the art, or essentially the same components. For example, a compressor 1 can be used as a device for supplying compressed air to refrigerators, petrochemical plants, or natural gas plants.

Figure 1:
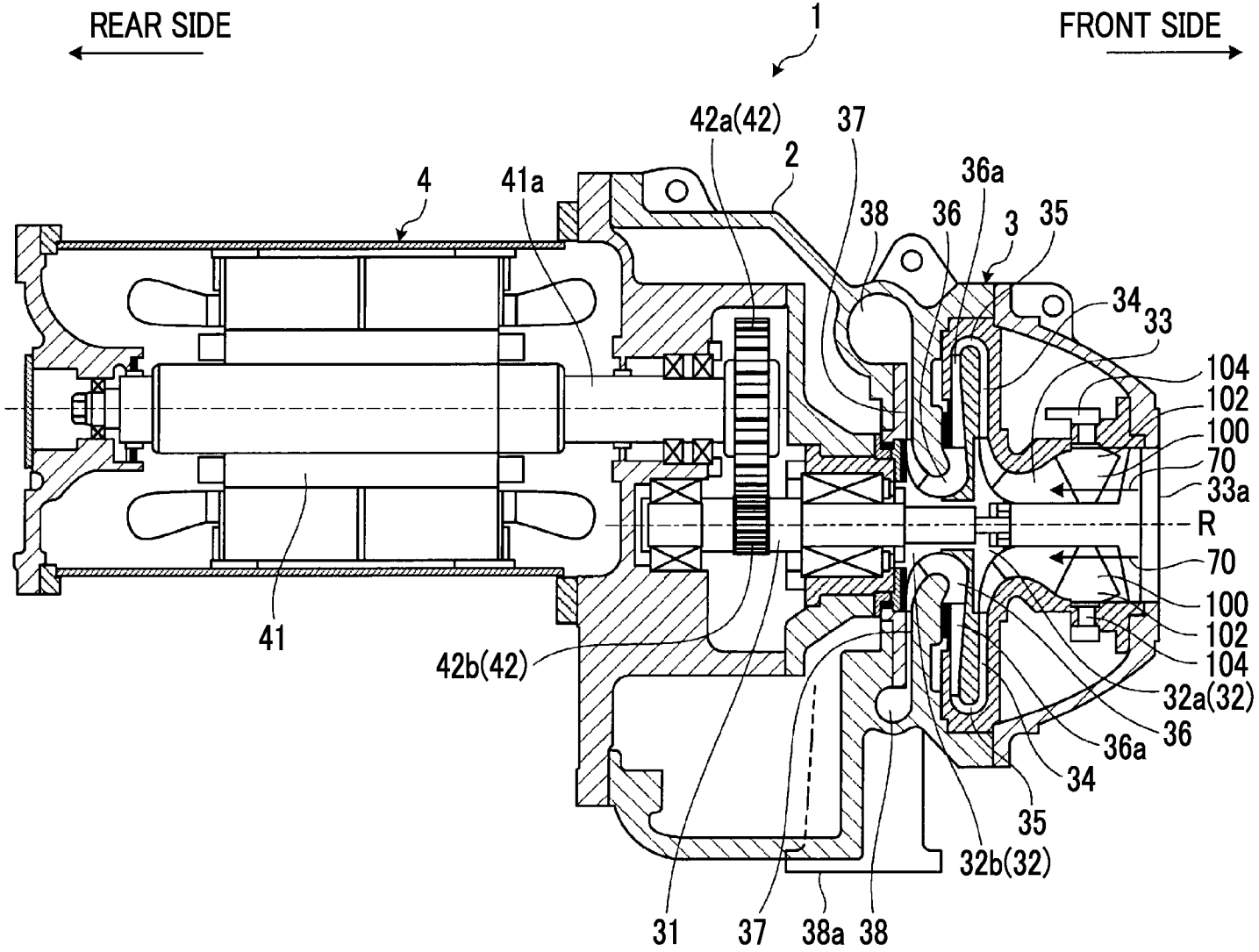
FIG. 1 is a schematic configuration view of a compressor according to the present embodiment.

As shown in FIG. 1, in the present embodiment, the compressor 1 is a two-stage compression centrifugal compressor which is an example of a turbo type compressor. In the compressor 1, a compression portion 3 and a drive portion 4 are accommodated in a casing 2.

The compression portion 3 is disposed on the front side of the casing 2 and includes a main shaft 31 which is rotatably supported to the casing 2. An impeller 32 is provided in the main shaft 31. The impeller 32 includes a first stage impeller 32*a* and a second stage impeller 32*b* which are provided to be arranged in an extension direction of an axis center R in the main shaft 31 in the extension direction of the main shaft 31.

Moreover, in order to discharge a compressed fluid after sucking and compressing the fluid, the compression portion 3 includes a flow path which is formed by the casing 2. The flow path includes a first stage inlet flow path 33, a first stage diffuser 34, a return flow path 35, a second stage inlet flow path 36, a second stage diffuser 37, and a discharge flow path 38. The first stage inlet flow path 33 is formed to reach the inflow side of the first stage impeller 32*a*. A suction port 33*a* for taking the fluid into the casing 2 is provided in the first stage inlet flow path 33. In addition, the inlet guide vane 100 is provided in the first stage inlet flow path 33. The first stage diffuser 34 is formed on an outflow side which is an outer periphery of the first stage impeller 32*a*. The inlet guide vane 100 will be described later. The return flow path 35 formed between the first stage diffuser 34 and the second stage inlet flow path 36 and the fluid is returned from the first stage diffuser 34 to the second stage inlet flow path 36 through the return flow path 35. The second stage inlet flow path 36 is formed to reach the inflow side of the second stage impeller 32*b*. A guide vane (IGV) 36*a* is provided in the second stage inlet flow path 36. The second stage diffuser 37 is formed on an outflow side which is an outer periphery of the second stage impeller 32*b*. The discharge flow path 38 is formed to communicate with the second stage diffuser 37. A discharge port 38*a* through which the fluid is discharged to the outside of the casing 2 is provided in the discharge flow path 38.

The drive portion 4 is disposed on the rear side of the casing 2 and includes an electric motor 41 and a power transmission portion 42. The power transmission portion 42 includes a first gear 42*a* which is provided on an output shaft 41*a* of the electric motor 41 and a second gear 42B which is provided on the main shaft 31 of the compression portion 3 and engages with the first gear 42*a*.

In the compressor 1, the main shaft 31 of the compression portion 3 rotated via the power transmission portion 42 by the power of the electric motor 41 of the drive portion 4. Accordingly, the impeller 32 rotates along with the main shaft 31. Accordingly, the fluid is sucked from the suction port 33*a* of the first stage inlet flow path 33 and is compressed by the first stage impeller 32*a* via the inlet guide vane 100, and thereafter, kinetic energy of the fluid is converted into internal energy by the first stage diffuser 34. In addition, the fluid is returned to the second stage inlet flow path 36 through the return flow path 35 and is compressed again by the second stage impeller 32*b* via the guide vane 36*a*, and thereafter, kinetic energy of the fluid is converted into internal energy by the second stage diffuser 37 and is discharged from the discharge port 38*a* of the discharge flow path 38.

Figure 2:
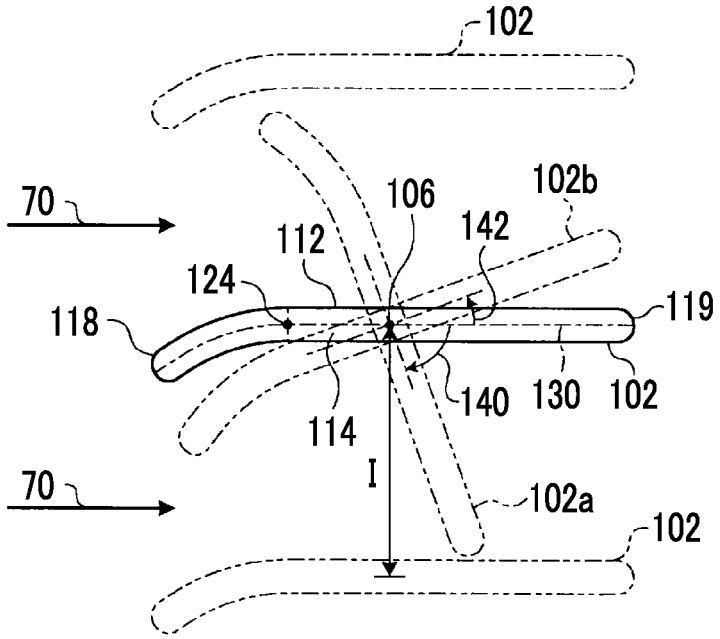
FIG. 2 is a developed view at a position at which the inlet guide vane is disposed.
Figure 3:
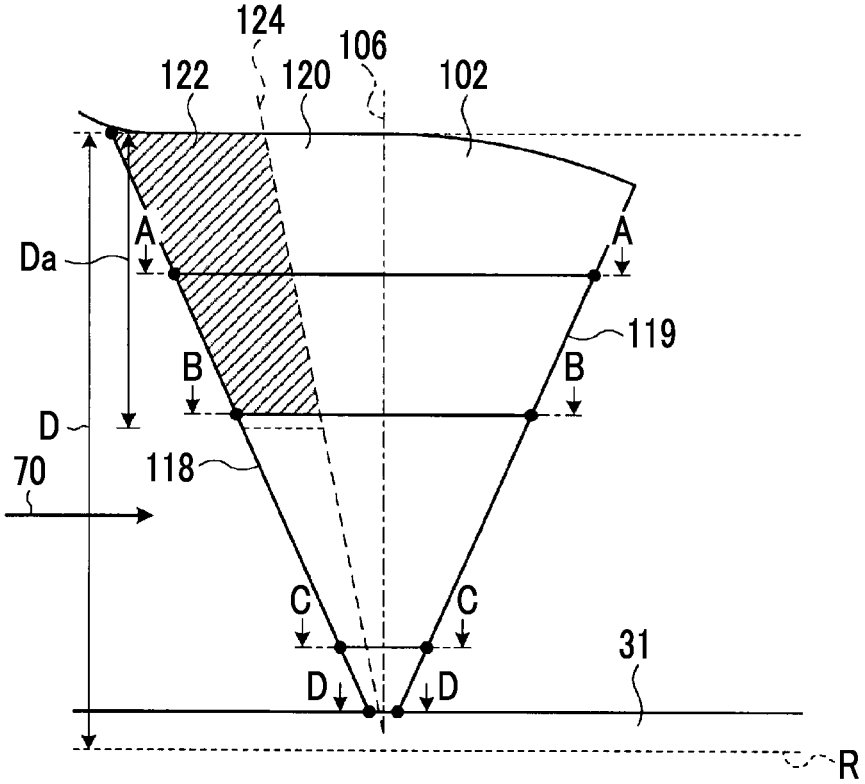
FIG. 3 is a front view showing a schematic configuration of the inlet guide vane.
Figure 4:
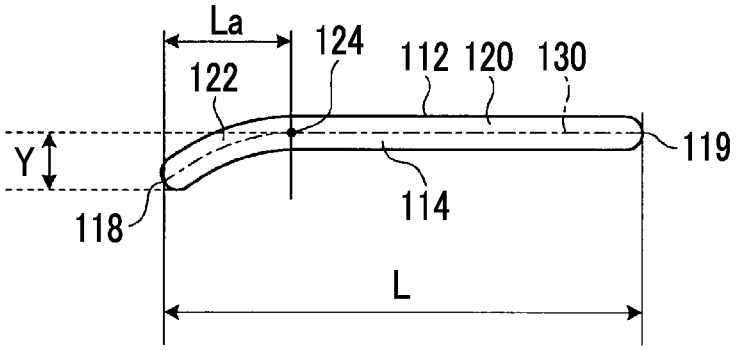
FIG. 4 is a sectional view taken along line A-A in FIG. 3.
Figure 5:
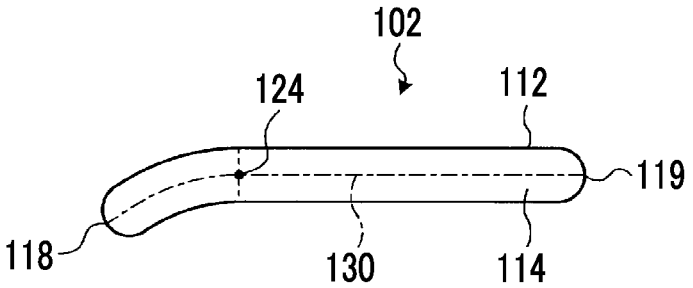
FIG. 5 is a sectional view taken along B-B in FIG. 3.
Figure 6:
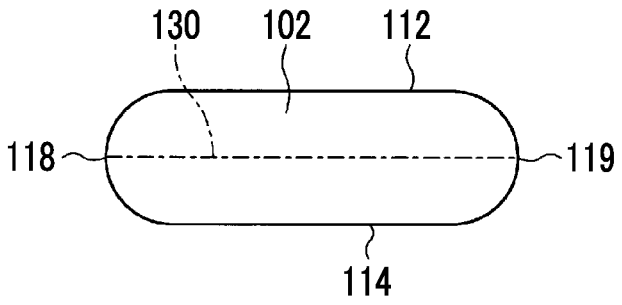
FIG. 6 is a sectional view taken along line C-C in FIG. 3.
Figure 7:
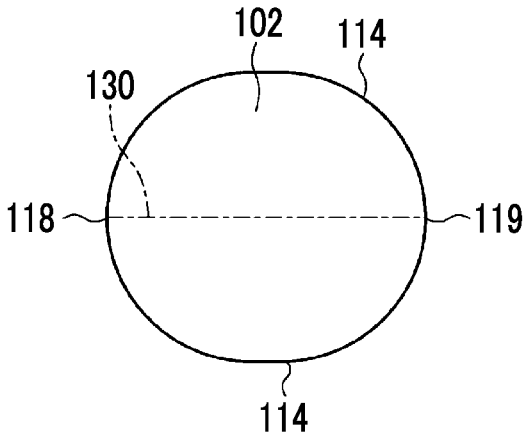
FIG. 7 is a sectional view taken along line D-D in FIG. 3.

Next, in addition to FIG. 1, with reference to FIGS. 2 to 7, the inlet guide vane (IGV, guidance guide vane) 100 will be described. FIG. 2 is a developed view at a position at which the inlet guide vane is disposed. FIG. 3 is a front view showing a schematic configuration of the inlet guide vane. FIG. 4 is a sectional view taken along line A-A in FIG. 3. FIG. 5 is a sectional view taken along line B-B in FIG. 3. FIG. 6 is a sectional view taken along line C-C in FIG. 3. FIG. 7 is a sectional view taken along line D-D in FIG. 3.

As described above, the inlet guide vane 100 is disposed in the flow path on the upstream side of the first stage impeller 32*a* in the flow direction of the fluid. The inlet guide vane 100 includes a plate portion 102 and a rotation portion 104 which rotates the plate portion 102. As shown in FIG. 2, a plurality of inlet guide vanes 100 are disposed around the axis center R of the first stage inlet flow path 33. In the inlet guide vane 100, an inter-blade distance which is a distance between the inlet guide vanes 100 adjacent to each other around the axis center R is 1. In addition, the inlet guide vane 100 rotates the plate portion 102 by the rotation portion 104 in conjunction with other inlet guide vanes 100.

The plate portion 102 is disposed in the first stage inlet flow path 33. Basically, the plate portion 102 is formed in a flat plate shape, and in the plate portion 102, a first surface 112 and a second surface 114 which are two surfaces having the widest area are parallel to each other. The plate portion 102 has a shape similar to a fan shape in which the length of the plate portion 102 in a flow direction 70 of the fluid is lengthened toward the outside in the radial direction of the axis center R and the outer end portion in the radial direction of the axis center R is formed in an arc shape. The end portion of the upstream side of the plate portion 102 in the flow direction 70 becomes a front edge 118 and the end portion of the downstream side thereof in the flow direction 70 becomes a rear edge 119. In the plate portion 102, the front edge 118 and the rear edge 119 are R-shaped. The shape of the plate portion 102 will be described in detail later.

The rotation portion 104 rotates the plate portion 102 with a rotation axis 106 in the radial direction of the axis center R as a base point. In the inlet guide vane 100, by rotating the plate portion 102 about the rotation axis 106 by the rotation portion 104, as shown in FIG. 2, the plate portion 102 can move to a position of a plate portion 102*a* or a plate portion 102*b*.

Here, in the present embodiment, as shown in FIG. 2, the position of the plate portion 102 in a direction in which a center line 130 of the plate portion is parallel to the flow direction 70 is set to an opening degree 100%. In the inlet guide vane 100, by rotating the plate portion 102 in a first rotation direction 140, for example, by moving the plate portion 102 in the direction of the plate portion 102*a*, the opening degree decreases. In this case, the second surface 114 becomes the surface on the upstream side. Since the opening degree decreases, the angle between the plate portion and the flow direction 70 increases, the plate portion 102*a* hinders the flow of the fluid, and the amount of the flowing-in fluid decreases. In the inlet guide vane 100, by rotating the plate portion 102 in a second rotation direction 142, for example, by moving the plate portion 102 in the direction of the plate portion 102*b*, the opening degree increases. In this case, the first surface 112 becomes the surface on the upstream side. In the plate portion 102*b*, the directions of the first stage impeller 32*a* on the downstream side and the vane become close to parallel according to an increase in the opening degree, and the direction the flow of the fluid passing through the plate portion 102*b* becomes a direction in which the fluid easily flows in the first stage impeller 32*a*. Accordingly, in the inlet guide vane 100, by positioning the plate portion 102 at the position of the plate portion 102*b*, a fluid which is more than the fluid at the position of the plate portion 102 can flow in.

In this way, in the inlet guide vane 100, by rotating the plate portion 102 by the rotation portion 104 to adjust the opening degree, the flowing-in fluid is adjusted. In the inlet guide vane 100, the rotation portion 104 rotates the plate portion 102 in the first rotation direction 140 in which the angle between the first stage impeller 32*a* and the plate portion 102 increases to decrease the opening degree, and thus, the amount of the flowing-in air decreases. In the inlet guide vane 100, the rotation portion 104 rotates the plate portion 102 in the second rotation direction 142 in which the angle between the first stage impeller 32*a* and the plate portion 102 decreases to increase the opening degree, and thus, the amount of the flowing-in air increases.

Next, the shape of the plate portion 102 will be described in more detail. The plate portion 102 includes a flat plate portion 120 and a bent portion 122 which is disposed on the upstream side from the flat plate portion 120 in the flow direction 70. The flat plate portion 120 and the bent portion 122 are integrated with each other. In addition, in the plate portion 102, one plate may be processed so as to provide the flat plate portion 120 and the bent portion 122, or other plates may be connected to each other so as to provide the flat plate portion 120 and the bent portion 122. The plate portion 102 can be manufactured by performing bending processing in a state where a bending position, a bending curvature, and a bending angle are designated. In addition, the plate portion 102 can be manufactured by casting in which a mold is made based on a bending position, a bending curvature, and a bending angle and press is performed. Moreover, the plate portion 102 can be manufactured by machining.

The flat plate portion 120 is a plate in which the first surface 112 and the second surface 114 are parallel to each other, and as shown in FIGS. 2 and 4, a center line (a line which connects middle points between the first surface 112 and the second surface 114 to each other) 130 in a cross-section orthogonal to the radial direction of the axis center R becomes a straight line.

The bent portion 122 is disposed on the upstream side of the flat plate portion 120 in the flow direction 70. In the bent portion 122, the center line 130 is inclined to the center line 130 of the flat plate portion 120. In the bent portion 122 of the present embodiment, the first surface 112 and the second surface 114 in the cross-section become curved lines parallel to each other, and the center line 130 also becomes a curved line. A boundary position 124 between the bent portion 122 and the flat plate portion 120 is positioned at a position at which the center line 130 is curved from the straight line. The bent portion 122 of the present embodiment has a shape which is inclined toward the second surface 114 side with respect to the flat plate portion 120, that is, the bent portion 122 has a shape in which the leading edge of the flat plate portion 120 inclined toward the second rotation direction 142 side. That is, the bent portion 122 has a shape in which an angle with respect to the flat plate portion 120 of the surface of the second surface 114 is smaller than 180°, and an angle with respect to the flat plate portion 120 of the surface of the first surface 112 is larger than 180°.

The bent portion 122 is provided within a range of a distance Da from the outer end portion in the radial direction in the radial direction of the axis center R. That is, the bent portion 122 is provided at a portion on the outside in the radial direction of the axis center R.

The bent portion 122 is formed within a range of a distance La from the front edge 118 in the cross-section orthogonal to the rotation axis 106. In the bent portion 122 of the present embodiment, a ratio of the distance La with respect to the entire length (distance) L of the plate portion 102 in the cross-section orthogonal to the rotation axis 106, that is, La/L becomes a constant value. Accordingly, the boundary position 124 of the plate portion 102 becomes a straight line which is inclined at a predetermined angle with respect to the rotation axis 106. In the plate portion 102, a warp amount which is a deformation amount (a length between the center line 130 of the flat plate portion 120 and the front edge 118 of the bent portion 122 in the direction orthogonal to the center line 130) of the bent portion 122 becomes Y.

The plate portion 102 has the above-described shape. As shown in FIGS. 4 and 5, in the portion on the outside in the radial direction of the axis center R, the bent portion 122 is provided on the front edge 118 side. As shown in FIGS. 6 and 7, in the portion on the inside in the radial direction of the axis center R, only the flat plate portion 120 is formed. In the plate portion 102, the bent portion is not provided in the portion on the inside in the radial direction of the axis center R, and thus, it is possible to simply process the plate portion 102. In addition, the bent portion is provided on the outside in the radial direction of the axis center R, and thus, it is possible to effectively guide the fluid.

In the inlet guide vane 100, the member disposed in the flow path is formed in a plate shape, and thus, it is possible to simply prepare the inlet guide vane 100, and it is possible to reduce the manufacturing cost.

In addition, in the inlet guide vane 100, the bent portion 122 of the plate portion 102 has the shape which is inclined toward the second surface 114 side with respect to the flat plate portion 120, that is, the bent portion 122 has the shape in which the leading edge of the flat plate portion 120 is inclined toward the second rotation direction 142 side. Accordingly, the angle between the bent portion 122 and the surface of the second surface 114 is smaller than 180° and the angle between the bent portion 122 and the surface of the first surface 112 is larger than 180°, and thus, in a case where the opening degree of the plate portion 102 is smaller than 100%, it is possible to prevent the fluid from being separated from a negative pressure surface (first surface), and it is possible to effectively guide the fluid.

In the plate portion 102, preferably, a relationship between the entire length L and La satisfies $0.1 \leq La \leq 0.3$. In the plate portion 102, the bent portion is provided to satisfy the relationship, and thus, it is possible to effectively prevent the fluid from being separated from the negative pressure surface of the inlet guide vane (IGV) 100, that is, the negative pressure surface of the plate portion 102.

In the plate portion 102, in a case where the distance from the axis center R to the end portion of the plate portion 102 in the radial direction of the axis center R is defined as D, preferably, a relationship between the distance D and the distance Da from the outer end portion in the radial direction satisfies $0 \leq Da/D \leq 0.9$. In the plate portion 102, the bent portion 122 is provided to satisfy the relationship, and thus, it is possible to manufacture the inlet guide vane 100 capable of effectively prevent the fluid from being separated from the negative pressure surface of the plate portion 102 while processing the inlet guide vane 100 in a reasonable manner.

In the plate portion 102, preferably, an absolute value of Y/l which is a relationship between the inter-blade distance l of the plate portions 102 adjacent to each other and the warp amount Y which is the deformation amount (the distance between the center line 130 of the flat plate portion 120 and the front edge of the bent portion 122 in the direction orthogonal to the center line 130) of the bent portion 122 is 0.15 or less, and more preferably, the absolute value of Y/l is 0.10 or less. In the plate portion 102, the bent portion 122 is provided to satisfy the relationship, and thus, it is possible to manufacture the inlet guide vane 100 capable of effectively prevent the fluid from being separated from the negative pressure surface of the plate portion 102 while wastefully largely bending the bent portion 122.

In the above-described embodiment, the bent portion 122 has the shape which is inclined toward the second surface 114 side with respect to the flat plate portion 120, that is, the bent portion 122 has the shape in which the leading edge of the flat plate portion 120 is inclined toward the second rotation direction 142 side, the angle between the bent portion 122 and the surface of the second surface 114 is smaller than 180°, and the angle between the bent portion 122 and the surface of the first surface 112 is larger than 180°. However, the present invention is not limited to this.

Figure 8:
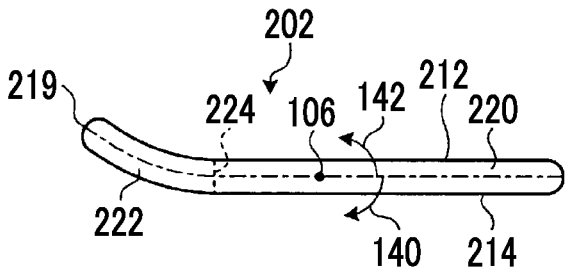
FIG. 8 is a sectional view of an inlet guide vane of another embodiment.
Figure 9:
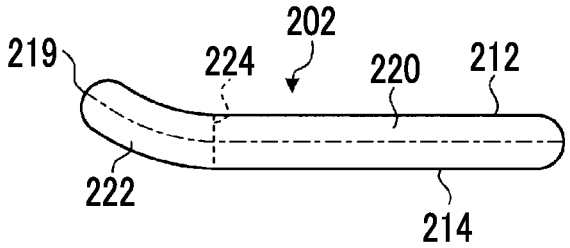
FIG. 9 is a sectional view at another position of the inlet guide vane shown in FIG. 8.

FIG. 8 is a sectional view of an inlet guide vane of another embodiment. FIG. 9 is a sectional view at another position of the inlet guide vane shown in FIG. 8. A plate portion 202 of the inlet guide vane shown in FIGS. 8 and 9 includes a flat plate portion 220 and a bent portion 222. In the plate portion 202, the flat plate portion 220 and the bent portion 222 are connected to each other at a boundary position 224. The bent portion 222 is disposed on a front edge 219 side. The plate portion 202 has a shape in which the bent portion 222 is inclined toward the first surface 212 side with respect to the flat plate portion 220. That is, in the plate portion 202, the bent portion 222 has a shape in which the leading edge of the first plate portion 220 is inclined toward the rotation direction 140 side. Accordingly, an angle between the bent portion 222 and the surface of the first surface 212 is smaller than 180° and an angle between the bent portion 222 and the surface of the second surface 214 is larger than 180°.

The plate portion 202, in a case where the opening degree is more than 100%, it is possible to prevent a fluid from being separated from the negative pressure surface (second surface), and it is possible to more effectively guide the fluid.

Figure 10:
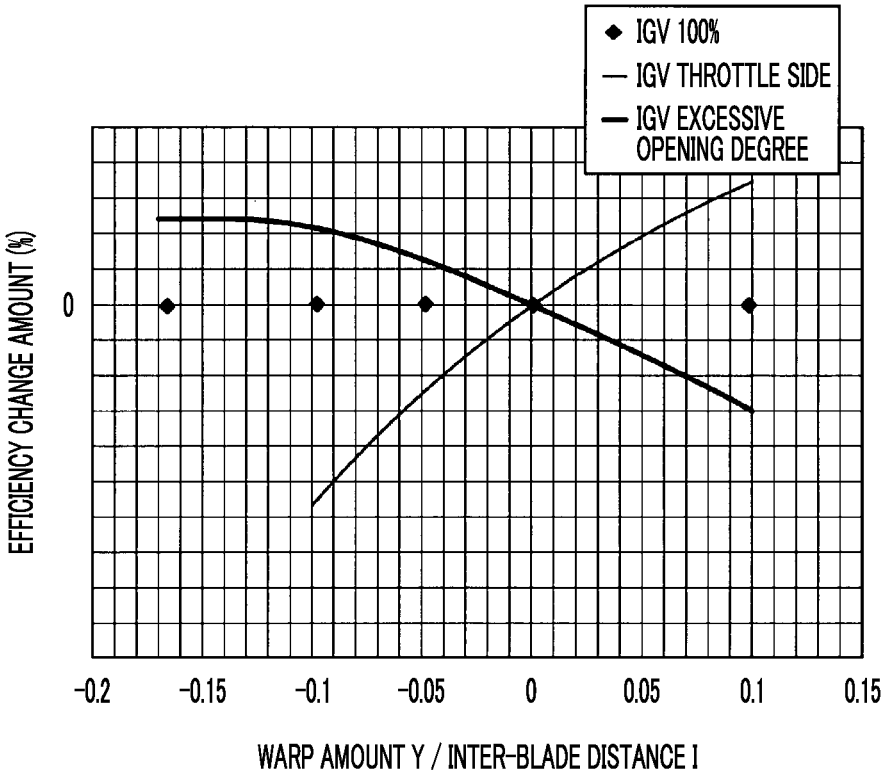
FIG. 10 is a schematic view showing a relationship between the shape of the inlet guide vane and an air resistance.

FIG. 10 is a schematic view showing a relationship between the shape of the inlet guide vane and an air resistance. FIG. 10 is an example showing results obtained by reviewing the relationship between the warp amount (deformation amount) Y and the inter-blade distance 1 in cases where the opening degrees of the inlet guide vane (IGV) respectively are 40%, 100%, and 130% is the plate portions 102 and 202. Here, in the warp amount Y, in the case where the bent portion 122 is deformed toward the second surfaces 114 and 214 side, that is, the case where the bent portion 122 has the shape inclined toward the side to be rotated at the time of being throttled as shown in FIGS. 2 to 7, the deformation amount is defined as a positive value. In addition, in the case where the bent portion 122 is deformed toward the first surfaces 112 and 212 side, that is, the case where the bent portion 122 has the shape inclined toward the side to be rotated at the time of having an excessive opening degree as shown in FIGS. 8 and 9, the deformation amount is defined as a negative value. As shown in FIG. 10, in the case where the warp amount is positive, it is possible to increase efficiency by performing the operation at the opening degree of 40%. In addition, in the case where the warp amount is negative, it is possible to increase efficiency by performing the operation at the opening degree of 130%.

As described above, in the plate portion of the inlet guide vane, the deformation direction of the bent portion is determined to the direction toward the first surface side or the direction toward the second surface side based on assumed operation conditions, specifically, based on the opening degree at the time of the operation emphasizing more isolation, and thus, it is possible to effectively perform the operation.

In the plate portions 102 and 202 of the above-described embodiments, preferably, in a state where each of the ratios of bent portions 122 and 222 with respect to the entire length L in each cross-section is constant, the boundary position 124 is a straight line which is inclined at a predetermined angle to the rotation axis 106. However, the present invention is not limited to this. In the plate portions 102 and 202, the boundary position 124 may be a curved line or may have a bent shape. Also in the case, La/L of each position satisfies the above-described relationship, and thus, it is possible to appropriately guide a fluid and it is possible to improve efficiency. In addition, the boundary position is not limited to the above.

Figure 11:
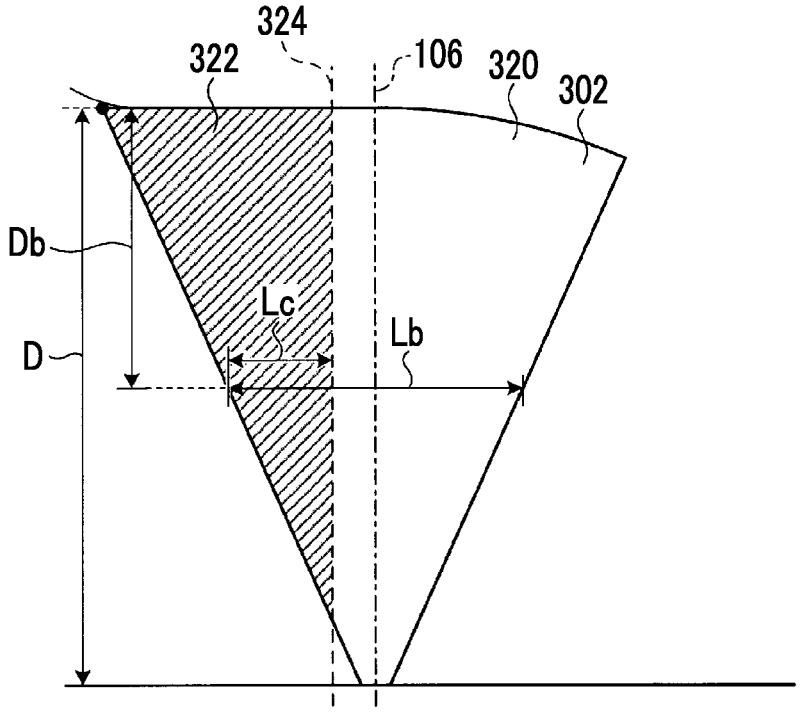
FIG. 11 is a front view of an inlet guide vane of still another embodiment.

FIG. 11 is a front view of an inlet guide vane of still another embodiment. A plate portion 302 shown in FIG. 11 includes a flat plate portion 320 and a bent portion 322. A boundary between the flat plate portion 320 and the bent portion 322 becomes a boundary position 324. The boundary position 324 is parallel to the rotation axis 106. In the plate portion 302, the center line is inclined with respect to the flat plate portion 320 in which a certain distance from the rotation axis 106, that is, the front edge side from the boundary position 324 on the front edge side becomes the bent portion 322.

In the plate portion 302, at a position of a distance Db from the outer end portion in the radial direction of the axis center R, a distance Lc from the front edge in the longitudinal direction of a cross-section orthogonal to the axis center R to the boundary position 324 is becomes 0.1 Lb or more and 0.3 Lb or less with respect to the entire length Lb at the position. Here, preferably, the distance Db satisfies $0.35 \leq Db/D \leq 0.7$ with respect to the distance D. Db becomes 0 at the outer end portion in the radial direction of the axis center R. Db/D at the outer end portion in the radial direction of the axis center R becomes 0 and Db/D at the inner end portion in the radial direction thereof becomes 1.0. In addition, preferably, the plate portion 302 has a shape which satisfies 0.1 Lb or more and 0.3 Lb or less at the position at which the relationship between the Db and D satisfies Db/D=0.5.

In the plate portion 302, the boundary position 324 is disposed at the above-described position, and at the position of the distance Db from the outer end portion in the radial direction of the axis center R, the bent portion is provided within a range from 0.1 L to 0.3 L on the leading edge side (front edge side) on the upstream side in the flow path with respect to the entire length L in the longitudinal direction of the cross-section orthogonal to the axis center R.

In this way, the boundary position is parallel to the rotation axis, and thus, it is possible to simply perform the processing. In addition, since more bent portions are disposed on the outside in the radial direction of the axis center R, it is possible to appropriately guide a fluid and it is possible to improve efficiency.

Figure 12:
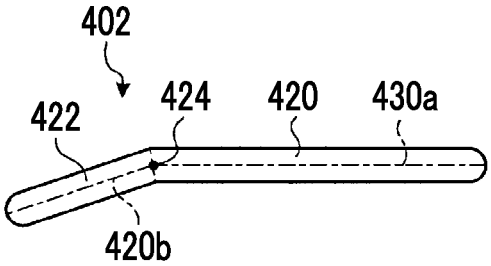
FIG. 12 is a sectional view of an inlet guide vane of still another embodiment.

In addition, in the embodiment, the center line of the bent portion is a curved line. However, the present invention is not limited to this. FIG. 12 is a sectional view of an inlet guide vane of still another embodiment. A plate portion 402 shown in FIG. 12 includes a flat plate portion 420 and a bent portion 422. In the plate portion 402, the flat plate portion 420 and the bent portion 422 are connected to each other at a boundary position 424. A center line 420*b* of the bent portion 422 in a cross-section orthogonal to the rotation axis 106 is a straight line and is inclined to a central axis 430*a* of the flat plate portion 420. That is, in the plate portion 420, the bent portion 422 is a flat plate which is inclined to the flat plate portion 420. In this way, even when the bent portion 422 is a flat plate, it is possible to obtain effects similar to the above-described those. In addition, it is possible simply perform the processing.

Figure 13:
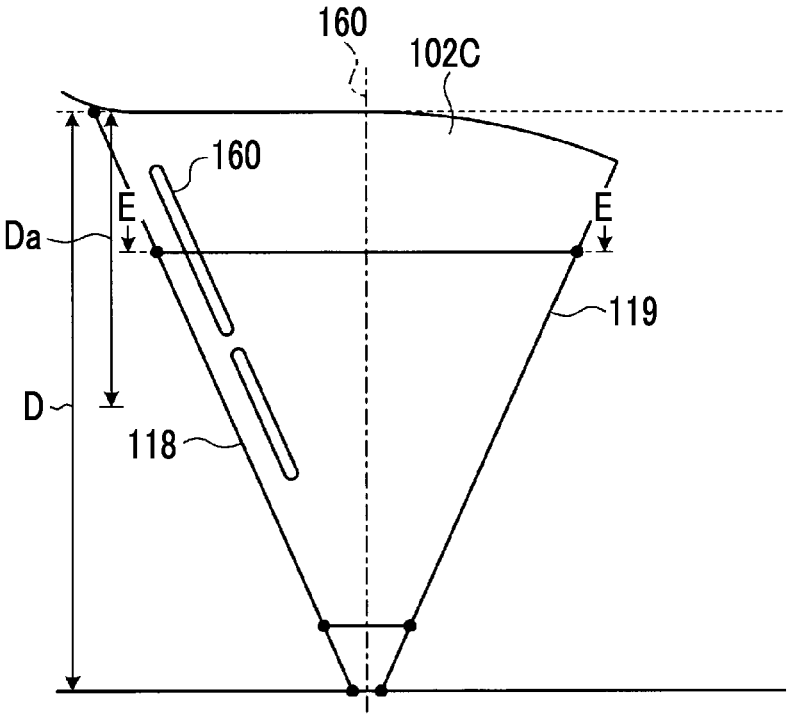
FIG. 13 is a front view of an inlet guide vane of still another embodiment.
Figure 14:
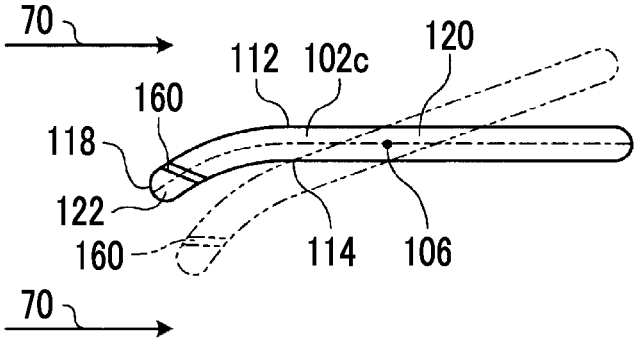
FIG. 14 is a sectional view of the inlet guide vane of still another embodiment.

FIG. 13 is a front view of an inlet guide vane of still another embodiment. FIG. 14 is a sectional view of the inlet guide vane of still another embodiment and is a sectional view taken along line E-E of the inlet guide vane shown in FIG. 13. A plate portion 102*c* shown in FIGS. 13 and 14 has a shape similar to that of the plate portion 102 except that slits are formed. Similar matters will not be described. A slit 160 is formed in the bent portion 122. The slit 160 penetrates from the first surface 112 to the second surface 114. That is, the slit 160 is formed to be parallel to the front edge 118 of the plate portion 102*c*. The slit 160 is a long hole in which an extension direction of the rotation axis 106 is a long side of the hole. In the slit 160, an opening of the first surface 112 (the surface on which the angle between the first surface and the flat plate portion 120 is larger than 180°) is formed on the upstream side in the flow direction of an opening of the second surface 114 (the surface on which the angle between the second surface and the flat plate portion 120 is smaller than 180°).

Figure 15:
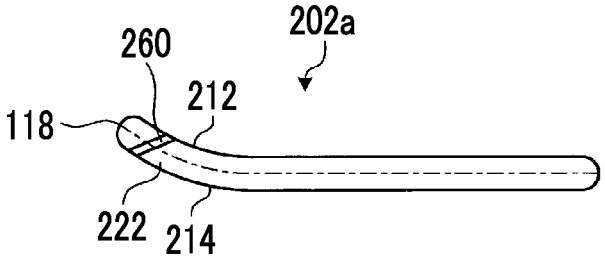
FIG. 15 is a sectional view of an inlet guide vane of still another embodiment.

Next, FIG. 15 is a sectional view of an inlet guide vane of still another embodiment. A plate portion 202*a* shown in FIG. 15 has the shape similar to that of the plate portion 202 except that a slit is formed. Similar matters will not be described. A slit 260 is formed in the bent portion 222. The slit 260 penetrates from the first surface 212 to the second surface 214. In addition, the slit 260 is formed to be parallel to the front edge 118 of the plate portion 202*a*. In the slit 260, an opening of the second surface 214 (the surface on which the angle between the second surface and the flat plate portion 120 is larger than 180°) is formed on the upstream side in the flow direction of an opening of the first surface 212 (the surface on which the angle between the first surface and the flat plate portion is smaller than 180°).

The slit is formed as described above, and thus, in a case where the plate portion is disposed on the side opposite to the side on which the flow can be effectively regulated by the above-described bent portion, a fluid passes through the slit. Therefore, it is possible to decrease loss and it is possible to effectively improve efficiency of the centrifugal compressor. In addition, the slit of the present embodiment is a straight hole in which the opening of the first surface and the opening of the second surface have the same shape. However, a throttle may be provided or an R shape may be provided in the opening portion.

REFERENCE SIGNS LIST

1: compressor
2: casing
3: compression portion
4: drive portion
31: main shaft
32: impeller
32*a*: first stage impeller
32*b*: second stage impeller
33: first stage inlet flow path
33*a*: suction port
34: first stage diffuser
35: return flow path
36: second stage inlet flow path
36*a*: guide vane
37: second stage diffuser
38: discharge flow path
38*a*: discharge port
70: flow direction
100: inlet guide vane
102: plate portion
104: rotation portion
106: rotation axis
112: first surface
114: second surface
118: front edge
119: rear edge
120: flat plate portion
122: bent portion
124: boundary position
130: center line
140: first rotation direction
142: second rotation direction
D, Da, La: distance
L: entire length

The invention claimed is:

1. An inlet guide vane which is disposed on an upstream side of an impeller in a flow path of a centrifugal compressor, the vane comprising:

a plate-shaped plate portion which is disposed in the flow path; and a rotation portion which rotates the plate portion with an axis in a radial direction of a rotary shaft of the centrifugal compressor as a rotation axis, wherein the plate portion includes a bent portion inclined with respect to other portions at a leading edge on an upstream side of the flow path in a cross-section orthogonal to the rotation axis of the rotation portion, and a center line of the bent portion is inclined to a center line of the other portions.

2. The inlet guide vane according to claim 1,
wherein a center line of the bent portion is a curved line in the cross-section orthogonal to the rotation axis of the rotation portion.

3. The inlet guide vane according to claim 1,
wherein a center line of the bent portion is a straight line in the cross-section orthogonal to the rotation axis of the rotation portion.

4. The inlet guide vane according to claim 1,
wherein a boundary position between the bent portion and other portions with respect to the entire length L in a longitudinal direction of the plate portion in the cross-section orthogonal to the rotation axis of the rotation portion is constant.

5. The inlet guide vane according to claim 4,
wherein the bent portion is formed within a range from 0.1 L to 0.3 L on the leading edge side on the upstream side in the flow path with respect to the entire length L.

6. The inlet guide vane according to claim 1,
wherein a distance between the rotation axis of the rotation portion in the cross-section orthogonal to the rotation axis of the rotation portion and the boundary position between the bent portion and the other portions is constant.

7. The inlet guide vane according to claim 6,
wherein the bent portion is formed within a range from 0.1 L to 0.3 L on the leading edge side on the upstream side in the flow path with respect to the entire length L in the longitudinal direction of the cross-section orthogonal to the rotation axis, at a position from 0.35 D to 0.7 D from an outer end portion in the radial direction with respect to a distance D of the outer end portion in the radial direction of the plate portion from the rotation axis.

8. The inlet guide vane according to claim 6,
wherein the bent portion is formed within a range from 0.1 L to 0.3 L on the leading edge side on the upstream side in the flow path with respect to the entire length L in the longitudinal direction of the cross-section orthogonal to the rotation axis, at a position of 0.5 D with respect to the distance D of the outer end portion in the radial direction of the plate portion from the rotation axis.

9. The inlet guide vane according to claim 1,
wherein the bent portion is inclined toward a side to be rotated at the time of being throttled.

10. The inlet guide vane according to claim 1,
wherein the bent portion is inclined toward a side to be rotated at the time of having an excessive opening degree.

11. The inlet guide vane according to claim 1,
wherein in the bent portion, a slit is formed from a surface on which an angle between the surface and the other portions is larger than 180° toward a surface on which an angle between the surface and the other portions is less than 180°, and
wherein in the slit, an opening of a surface side on which an angle between the surface and the other portions is larger than 180° is formed on an upstream side in the flow direction of an opening of a surface on which an angle between the surface and the other portions is less than 180°.

12. A centrifugal compressor, comprising:
the inlet guide vane according to claim 1; and
an impeller which is disposed on a downstream side of the inlet guide vane.

* * * * *